US006241632B1

(12) United States Patent
Obsniuk

(10) Patent No.: US 6,241,632 B1
(45) Date of Patent: Jun. 5, 2001

(54) THROW AND CATCH BALL GAME

(76) Inventor: George K. Obsniuk, 44905 Huntingcross Dr., Novi, MI (US) 48375

( * ) Notice: Subject to any disclaimer, the term of this patent is extended or adjusted under 35 U.S.C. 154(b) by 0 days.

(21) Appl. No.: 09/596,699

(22) Filed: Jun. 19, 2000

Related U.S. Application Data

(60) Provisional application No. 60/139,832, filed on Jun. 21, 1999.

(51) Int. Cl.[7] ..... A63B 67/00

(52) U.S. Cl. ..... 473/509; 473/505; 473/515

(58) Field of Search ..... 473/505, 509, 473/510, 515, 506, 507, 508; 273/412

(56) References Cited

U.S. PATENT DOCUMENTS

| | | | | |
|---|---|---|---|---|
| 1,942,719 | * | 1/1934 | Mikamo et al. | 473/507 |
| 2,243,019 | * | 5/1941 | Singer | 473/508 |
| 3,083,018 | * | 3/1963 | Kauffman et al. | 273/412 |
| 3,313,542 | * | 4/1967 | Johnston | 473/507 |
| 3,887,184 | | 6/1975 | Cavaliere . | |
| 4,752,076 | * | 6/1988 | Gelinas, Jr. | 473/505 |
| 4,863,174 | | 9/1989 | Cummings . | |
| 5,368,306 | * | 11/1994 | Madsen | 473/510 |

FOREIGN PATENT DOCUMENTS

| | | | | |
|---|---|---|---|---|
| 661779 | * | 6/1938 | (DE) | 473/FOR 200 |
| 1443902 | * | 12/1988 | (SU) | 273/412 |

* cited by examiner

*Primary Examiner*—Raleigh W. Chiu
(74) *Attorney, Agent, or Firm*—Charles W. Chandler

(57) ABSTRACT

A hand-held, hand-manipulated catch ball game comprising a ball used with an assembly of two opposing receptacles, one above the other, each having ball exit openings positioned to direct the ball along an open ended track. A handle is located at the track side midway between the receptacles and the track ends. The assembly handle is held by the player's hand with the thumb of the hand toward the open end of the track. The ball is placed on the receptacle end of the track and the assembly is tilted to roll the ball down the track. As the ball nears the track end, the player manipulates the assembly to throw the ball a short distance upward into the air. The player then quickly rotates the assembly approximately one hundred eighty degrees to catch the ball in the previously downward facing receptacle. Having caught the ball, the assembly is again tilted to roll the ball down the track to be thrown and caught again to continue to play, with alternately clockwise/counterclockwise rotation, to see how many times the ball can be thrown and caught without having to replace the ball on the track by hand.

8 Claims, 4 Drawing Sheets

THROW AND CATCH BALL GAME

This application claims the benefit of U.S. Provisional Application No. 60/139,832, filed Jun. 21, 1999.

BACKGROUND AND SUMMARY OF THE INVENTION

This invention relates to a throw-and-catch ball game wherein the user manipulates a hand-held implement to launch a ball into the air and then to catch the ball in a receptacle at one end of the implement.

The implement has two oppositely-facing ball tracks and a ball receptacle at one end of each track. Each receptacle has a side opening for allowing the ball to move from the receptacle onto the associated track, whereby the implement can then be manipulated to launch the ball into the air for capture by the other receptacle.

U.S. Pat. No. 3,887,184 to Joseph Cavaliere and U.S. Pat. No. 4,863,174 to Gerald W. Cummings show throw-and-catch ball apparatus. The present invention improves on this patented apparatus in that the implement used in playing the game is manipulated so that the person's wrist is rotated approximately one hundred eighty degrees between the ball-launching event and the ball-catching event. A greater degree of skill is required, as compared with the skill level required with the apparatus of U.S. Pat. No. 3,887,184 or U.S. Pat. No. 4,863,174.

DESCRIPTION OF A PREFERRED EMBODIMENT OF THE INVENTION

Figure 1:
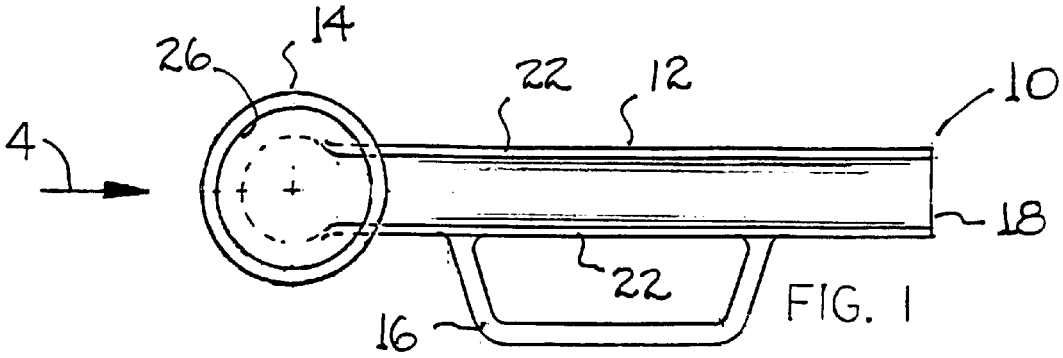
FIG. 1 is a top plan view of an apparatus embodying the present invention.
Figure 2:
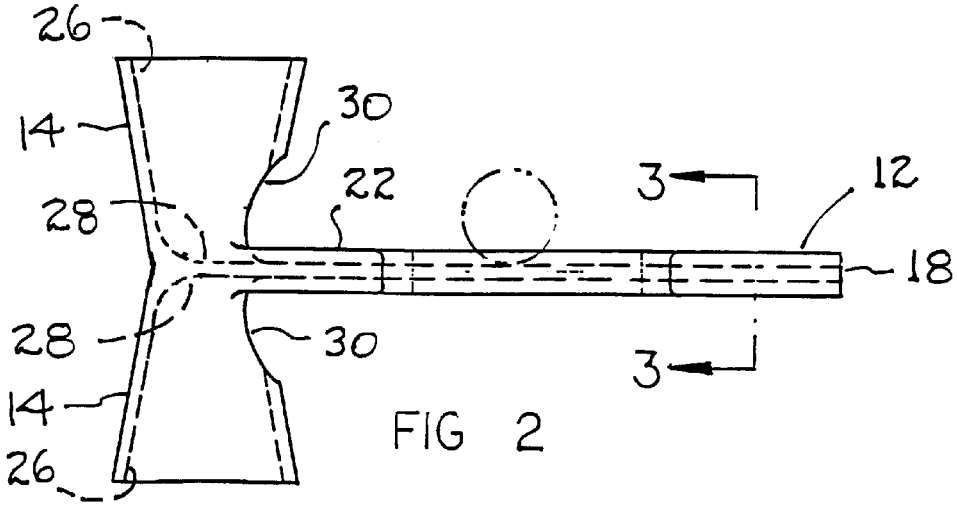
FIG. 2 is a side elevational view of the FIG. 1 apparatus.

FIGS. 1 through 4 illustrate an apparatus embodying the invention. The apparatus includes a hand-held implement 10 that comprises an elongated bar structure 12 and two oppositely-facing ball receptacles 14, 14 extending from one end of the bar structure. A handle 16 extends laterally from the bar structure at a location approximately midway between receptacles 14 and the free end 18 of the bar structure.

Figure 3:
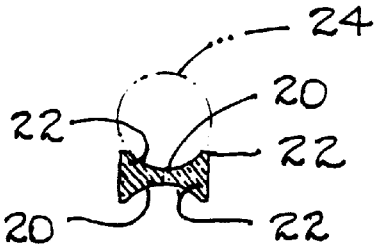
FIG. 3 is a fragmentary sectional view taken on line 3—3 in FIG. 2.

Opposite side surfaces of bar structure 12 have concave cross-sections, as shown at 20, 20 in FIG. 3, to form two sets of laterally spaced rails 22, 22. The concave cross-sections conform to the surface contour of a ball 24, such that the ball can roll freely along the concave surface. Rails 22, 22 form tracks that prevent ball 24 from rolling off the side edges of bar structure 12.

Figure 6:
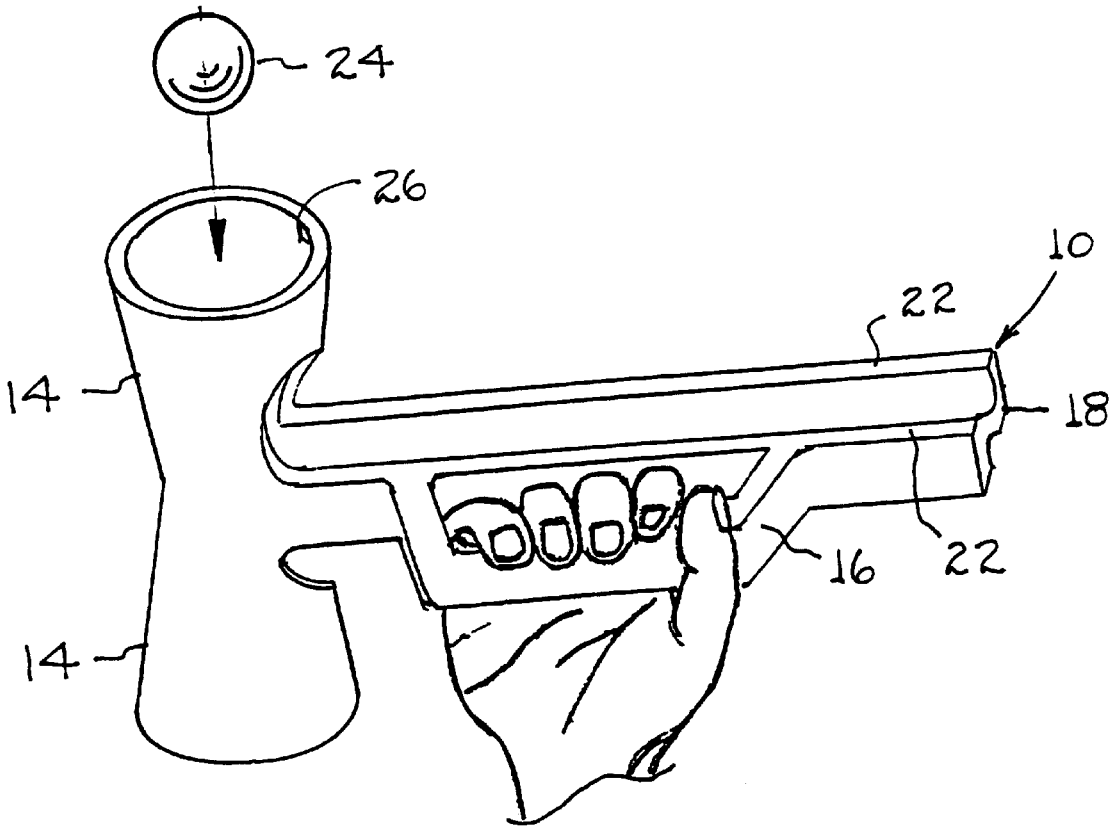
FIG. 6 is a perspective view of the FIG. 1 apparatus in the grasp of a user's hand, e.g. while the apparatus is in use.

Each ball receptacle 14 has a frusto-conical, funnel shape designed to receive ball 24 when implement 10 is manipulated so that the receptacle is directly under a downwardly-falling ball, as shown in FIG. 6. Each receptacle 14 has an open mouth 26 with a diameter that is approximately twice the diameter of ball 24. Bottom wall 28 of each receptacle has a concave spherical contour that merges smoothly with the concave surface contour 20 on the bar structure side surface. An enlarged opening 30 in the receptacle sidewall permits the ball to roll from the receptacle onto the track formed by surface contour 20. The receptacles and track structures on each side of the bar structure are similar to each other (i.e. mirror images of each other).

In using the apparatus, the user grasps handle 16 in the manner shown in FIG. 6. While holding implement 10 so the uppermost track is in a horizontal position, the user drops ball 24 into the upwardly facing receptacle 14; inertial forces cause the ball to roll onto the uppermost track.

By turning the handle 16 slightly, it is possible to launch ball 24 upwardly from the free end 18 of the bar structure. The user can continue the handle 16 rotation for approximately one hundred eighty degrees to bring the downwardly-facing receptacle 24 into an upwardly facing condition. By appropriate manipulation of implement 10, the user can bring the upwardly-facing receptacle 14 to a position beneath the airborne ball 24. The ball falls into the receptacle, and rolls onto the associated track 22 for the next cycle. The user reverses the direction of wrist motion during each successive cycle.

An object of the game is accomplishing as many throw-and-catch cycles as possible before failure to catch the ball. Alternatively, the game can be played, with the object being to accomplish as many throw-and-catch cycles as possible in a given time period.

Figure 7:
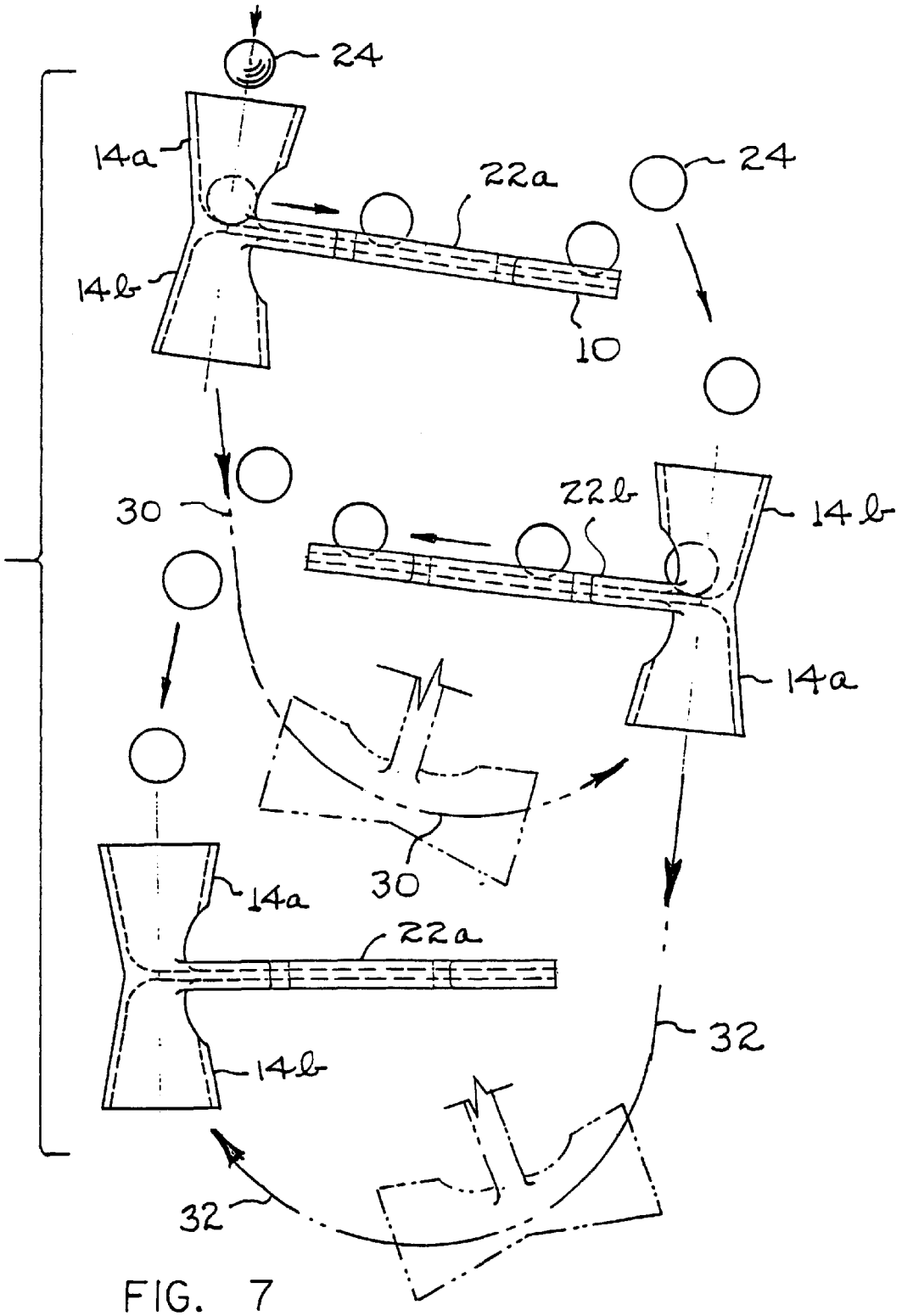
FIG. 7 shows the FIG. 1 apparatus in various positions during the process of launching and catching a ball.

FIG. 7 shows the sequence of motions occurring during cyclic movement of implement 10. Initially, receptacle 14*a* faces upwardly to receive ball 24. The ball rolls from receptacle 14*a* onto the uppermost track 22*a*, as shown in the top-most illustration. After the ball has been launched, the user rotates his wrist in a counterclockwise direction as the receptacle assembly moves along pathline 30 until receptacle 14*b* is in an upwardly-facing condition (as shown in the intermediate illustration). Ball 24 is caught in receptacle 14*b* and allowed to roll along associated track 22*b* for the next launch event. The user then reverses the direction of wrist rotation, so that the receptacle assembly is moved along pathline 32 to the position depicted in the lowermost illustration.

A successful launch and catch cycle requires considerable skill, dexterity, and hand-eye coordination.

As compared to the skill level required by the games depicted in aforementioned U.S. Pat. Nos. 3,887,184 and 4,863,174, the game of the present invention has a considerable greater skill level, due to the required dexterity and hand-eye coordination.

Figure 5:
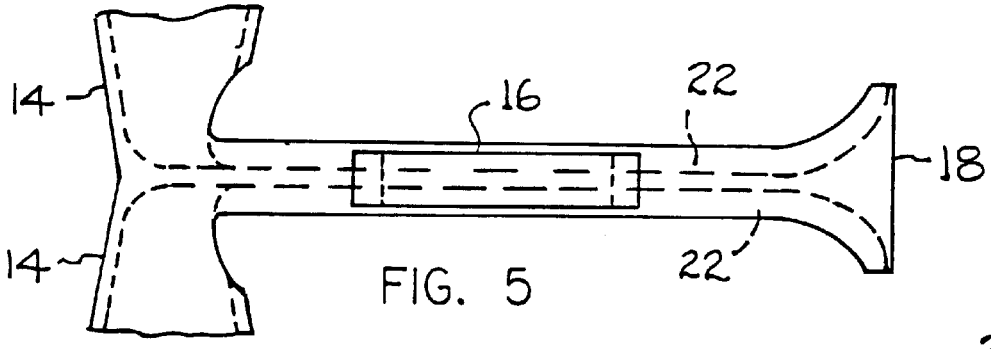
FIG. 5 is a view taken in the same direction as FIG. 2, but showing another apparatus constructed according to the invention.
Figure 4:
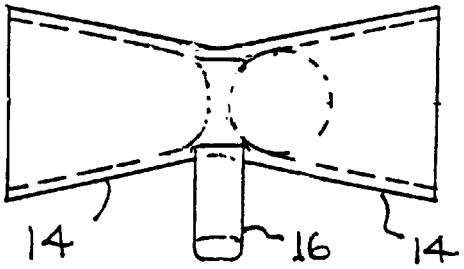
FIG. 4 is an end elevational view of the FIG. 1 apparatus, taken in the direction of arrow 4 in FIG. 1.

Some variation in the construction of implement 10 can be employed while still practicing the invention. For example, the track structures can have various different lengths and cross-sections. Additionally, receptacles 14 can be cup shaped or a combination of essentially vertical outer walls with frusto-conical inside walls. In either design, the enlarged opening 30 in the receptacle side can be a continuous opening extending vertically upward from the receptacle base 28 to the receptacle open mouth 26. Also, the implement can be molded, or otherwise formed, in one or more pieces, according to manufacturing cost considerations. FIG. 5 shows a variant of the invention wherein each track 22 has an upturned free end, to facilitate the launch of ball 24. In all major respects, the FIG. 5 implement functions in the same fashion as the FIG. 1 implement.

FIGS. 8 to 12 illustrate another embodiment of the invention comprising a hand-held implement 100.

Implement 100 comprises an elongated bar structure 112 and two oppositely-facing ball receptacles 114, 114 extending from one end of the bar structure. A handle 116 having an opening 117, extends laterally from the bar structure at a location approximately midway between receptacles 114 and the free end 118 of the bar structure.

Figure 11:
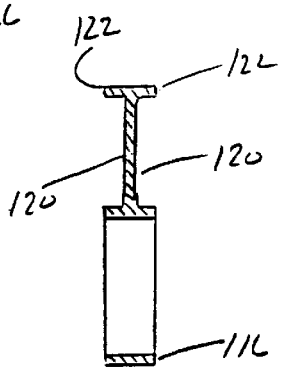
FIG. 11 is a fragmentary sectional view taken along lines 11—11 of FIG. 8.
Figure 12:
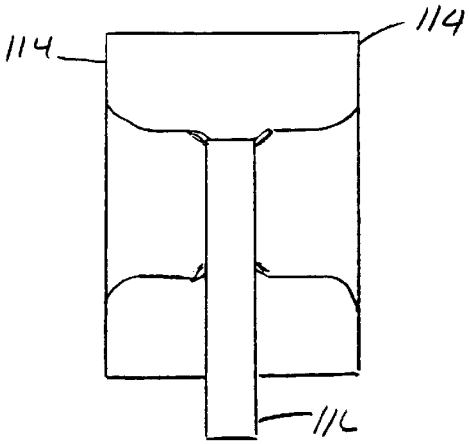
FIG. 12 is an enlarged view as seen from the right side of FIG. 8.

Opposite side surfaces of bar structure 112 have channel-shaped cross-sections, as shown at 120, 120 in FIG. 11, forming two sets of laterally spaced rails 122, 122. The channel-shaped cross-sections guide a ball 124, such that the ball can roll freely between the rails. Rails 122, 122 prevent ball 124 from rolling off the side edges of bar structure 112.

Figure 13:
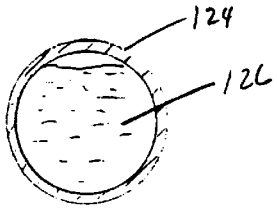
FIG. 13 is a sectional view of a hollow ball, such as a ping pong ball which may be partially filled with a fluid or loose granular material to reduce the tendency of the ball bouncing out of the receptacle.

Referring to FIG. 13, ball 124 is preferably a hollow ball partially filled with a fluid 126 such as water or loose solid material 126 to reduce the tendency of the ball bouncing out of the receptacles. Note that receptacles 114, 114 are shallower than receptacles 14, 14.

Each cup-like receptacle 114 has an open mouth 128 having a diameter that is approximately twice the diameter of ball 124. The bottom wall of each receptacle is a continuation of surface 120 of the bar structure 112. An enlarged opening 130 in the receptacle sidewall permits the ball to roll from the receptacle onto the track surface 120 between rails 122, 122. The receptacles and track is structures on each side of the bar structure are similar to each other (i.e. mirror images of each other).

Figure 8:
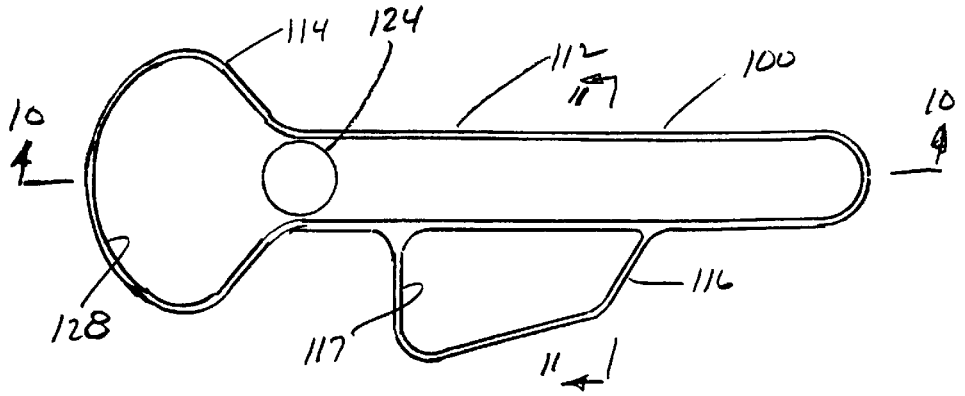
FIG. 8 is top plan view of another apparatus embodying the invention.

The FIG. 8 implement functions in the same manner as the FIG. 1 implement.

Figure 9:
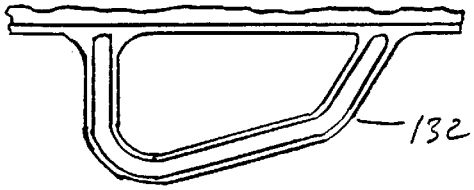
FIG. 9 is a view of another handle of the embodiment of FIG. 8.
Figure 10:
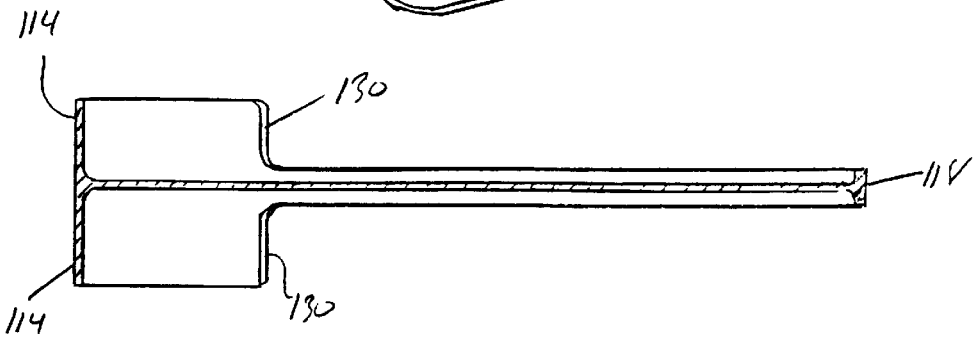
FIG. 10 is a fragmentary sectional view taken along lines 10—10 of FIG. 8.

FIG. 9 illustrates an alternative handle structure 132.

Having described my invention, I claim:

1. A ball game apparatus, comprising:

a hand-held implement that includes an elongated bar structure having first and second ends;

first and second ball receptacles located at said first end of said bar structure;

said ball receptacles facing in opposite directions;

said bar structure having first and second elongated tracks facing in opposite directions;

said first receptacle having a first opening therein for rolling a ball onto said first track;

said second receptacle having a second opening therein for rolling a ball onto said second track; and each of said tracks having an unobstructed ball-launching surface remote from the associated receptacle;

whereby said implement can be manipulated so that a ball can be launched from one track and then captured in the ball receptacle associated with the other track.

2. A ball game apparatus as defined in claim 1, in which the bar structure is a linear structure following a pair of linear tracks.

3. A ball game apparatus as defined in claim 1, in which the first and second ball receptacles are disposed on opposite sides of the bar structure.

4. A ball game apparatus as defined in claim 1, in which the receptacles have a frusto conical side walls.

5. A ball game apparatus as defined in claim 1, including a ball at least partially filled with a material that reduces the bounce characteristics of the ball.

6. A ball game apparatus as defined in claim 5, in which the material comprises sand.

7. A ball game apparatus as defined in claim 5, in which the material comprises a liquid.

8. A method of playing a throw-and-catch ball game, comprising:

a. holding an implement in one hand, wherein said implement has two oppositely-facing ball tracks, and a ball receptacle communicating with each of said tracks;

b. moving the implement to launch a ball from one track;

c. rotating the wrist in one direction approximately one hundred eighty degrees to catch the ball in the receptacle associated with the other track;

d. moving the implement to launch the ball from said other track; and e. rotating the wrist in the other direction approximately one hundred eighty degrees to catch the ball in the receptacle associated with said one track.

* * * * *